US007614886B2

(12) United States Patent
Choi

(10) Patent No.: US 7,614,886 B2
(45) Date of Patent: Nov. 10, 2009

(54) JUNCTION BOX HAVING BLOCK TYPE STRUCTURE

(75) Inventor: Myeong Sun Choi, Gyeonggi-do (KR)

(73) Assignees: Hyundai Motor Company, Seoul (KR); Kia Motor Company, Seoul (KR)

( * ) Notice: Subject to any disclaimer, the term of this patent is extended or adjusted under 35 U.S.C. 154(b) by 0 days.

(21) Appl. No.: 12/006,356

(22) Filed: Jan. 2, 2008

(65) Prior Publication Data

US 2008/0261459 A1 Oct. 23, 2008

(30) Foreign Application Priority Data

Apr. 20, 2007 (KR) ..... 10-2007-0038709

(51) Int. Cl.
*H01R 12/00* (2006.01)

(52) U.S. Cl. ..... 439/76.2; 439/620.27

(58) Field of Classification Search ..... 439/76.2, 439/620.27, 949
See application file for complete search history.

(56) References Cited

U.S. PATENT DOCUMENTS 5,755,579 A * 5/1998 Yanase et al. ..... 439/76.2
5,764,487 A * 6/1998 Natsume ..... 361/775
6,121,548 A * 9/2000 Matsuoka ..... 174/59
6,524,136 B2 * 2/2003 Kawaguchi et al. .... 439/620.26
6,739,889 B1 * 5/2004 Daggett et al. ..... 439/157

* cited by examiner

*Primary Examiner*—Thanh-Tam T Le
(74) *Attorney, Agent, or Firm*—Edwards Angell Palmer & Dodge LLP; Peter F. Corless

(57) ABSTRACT

A junction box having a block type structure is provided. The junction box having a block type structure includes: a lower cover of a quadrangular shape in which an inner groove having an opened upper part is formed and at one side of which a sliding groove is formed; a main body at one side of which a flat plate having a step surface is coupled to the sliding groove of the lower cover by downwardly sliding and in an upper part of which a plurality of block grooves are formed; a block assembly being received and assembled in the block grooves of the main body; and an upper cover coupled to the main body by wrapping an upper part of the main body so as to protect the block assembly.

9 Claims, 10 Drawing Sheets

JUNCTION BOX HAVING BLOCK TYPE STRUCTURE

CROSS-REFERENCE TO RELATED APPLICATION

This application claims the benefit of Korean Application No. 10-2007-0038709 filed on Apr. 20, 2007, the entire disclosure of which is incorporated herein by reference.

BACKGROUND

1. Technical Field

The present invention relates to a junction box having a block type structure which can be manufactured in a simpler way and can be applied to various vehicle models.

2. Background Art

Electrical devices of a vehicle are compared to human nervous system. If the electrical devices do not function well, the vehicle cannot operate properly.

The electrical devices are divided into engine side electrical devices and vehicle body side electrical devices. The engine side electrical devices include an ignition device including an ignition coil, a power distributor high-voltage cable, and an ignition plug, and a charge device including a generator and a regulator. The vehicle body side electrical devices include a storage battery, a light device for lighting, indicating, and signaling, and a cooling and heating device and an instrument warning display device provided in an instrument panel.

The electrical devices of a vehicle are connected to an electronic control unit (ECU) using wires within an engine room of the vehicle, and a junction box is used as an intermediary for connecting the wires and the ECU.

U.S. Pat. No. 6,672,883 discloses a junction box structure of vehicles which includes a connector housing, a relay housing, and a fuse housing provided in an upper case thereof, and a busbar connected to a lower part thereof. Japanese Patent Application Publication No. 2002-135944 discloses a junction box structure in which a connector module, a relay module, and a fuse module are connected by a busbar between an upper case and a lower case.

However, the prior art junction box structures have disadvantages. Namely, the prior art structures cannot be applied to various kinds of vehicle models because they are not formed in a standard structure applicable to various vehicle models. Further, they are required to be formed in a retainer structure (not shown) in order to fix a terminal connected to each housing or each module, which increases overall weight and manufacturing costs and remarkably deteriorates workability as well.

FIGS. 1 and 2 are perspective views illustrating the structure of a conventional junction box.

As shown in FIG. 1, the conventional junction box includes a lower case 110 in which a plurality of connectors 100 are provided, a main body 120 connected to the connector 100, and an upper case 130 mounted to an upper part of the main body 120.

A plurality of circuit boards in which a conductive pattern and a non-conductive pattern are formed can be mounted in the main body 120, in which case plurality of circuit boards are stacked in the main body 120.

Components such as a relay and a fuse are positioned in a circuit board disposed in an upper part of the plurality of circuit boards, a busbar for commonly connecting the fuse, etc. is disposed in upper and lower circuit boards, and a busbar layer in which busbars are formed in a layer is formed in the upper and lower circuit boards. Further, as shown in "A" of FIG. 2, wire-to-wire may be additionally applied, in addition to the connectors.

The conventional junction box, however, has disadvantages. A circuit board should be changed according to a particular specification of a vehicle, and the structure of the conventional junction box has to be changed according to the change of circuit board, which requires a long period of time and additional costs for developing and manufacturing a product. Further, the junction box has a complicated structure involving many coupled components, which increases the weight of the junction box and production costs thereof as well.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to solve the above problems, and one of the object of the present invention is to provide a junction box having a block type structure that has a simpler structure and can be manufactured in a cost effective way and applied to various vehicle models.

According to an aspect of the present invention, there is provided a junction box having a block type structure including: a lower cover of a quadrangular shape in which an inner groove having an opened upper part is formed and at one side of which a sliding groove is formed; a main body at one side of which a flat plate having a step surface is coupled to the sliding groove of the lower cover by downwardly sliding and in an upper part of which a plurality of block grooves are formed; a block assembly being received and assembled in the block grooves of the main body; and an upper cover coupled to the main body by wrapping an upper part of the main body so as to protect the block assembly.

In a preferred embodiment, the block assembly comprises: a busbar block comprising a busbar made of a metal plate for distributing power supplied from a power supply unit; a plurality of relay blocks absorbing a joint and an electric wire between relays for turning on/off a signal; a multi-fuse block in which a plurality of fuses are provided for intercepting an over current; and a connector block for connecting the busbar block, the relay block, and the multi-fuse block to each other and connecting a plurality of wire harnesses.

In another preferred embodiment, the busbar block comprises an upper case, a lower case, a plurality of busbars disposed between the upper case and the lower case, and a plurality of insulation plates disposed between the plurality of busbars.

In still another preferred embodiment, the plurality of relay blocks comprise two micro relay blocks and two mini relay blocks.

In yet another preferred embodiment, each of the blocks of the block assembly is formed in a relay block standardized so as to be applied to various vehicle models.

In still yet another preferred embodiment, the plurality of block grooves formed in the main body comprise: a busbar block groove formed adjacently to one side of the main body for receiving the busbar block; a plurality of relay block grooves formed at one side of the busbar block groove for receiving the plurality of relay blocks; a connector block groove formed at one side of the relay block groove for receiving the connector block; and a multi-fuse block groove formed adjacently to the other side of the main body for receiving the multi-fuse block.

In a further preferred embodiment, a plurality of protruded plates having a bolt groove for mounting the main body in an engine room are formed in the main body.

In another further preferred embodiment, one side of the lower cover and one side of the main body are coupled by a clip.

In still another further preferred embodiment, a side groove is formed in the main body for receiving and coupling both ends of the clip by downwardly sliding the clip, and a clip groove is formed in a portion of the lower cover corresponding the position of the side groove for receiving and coupling both ends of the clip.

In yet a further preferred embodiment, the clip is formed in a shape in which the width of a lower part is narrower than that of an upper part, and the side groove and the clip groove to which the clip is coupled are formed in a shape corresponding to the shape of the clip.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

Other aspects of the invention are discussed infra.

BRIEF DESCRIPTION OF THE DRAWING

Preferred embodiments of the invention will be described in detail with reference to the following drawings in which like numerals refer to like elements.

DETAILED DESCRIPTION

Hereinafter, exemplary embodiments of a junction box having a block type structure according to the present invention will be described in detail with reference to the accompanying drawings.

Figure 1:
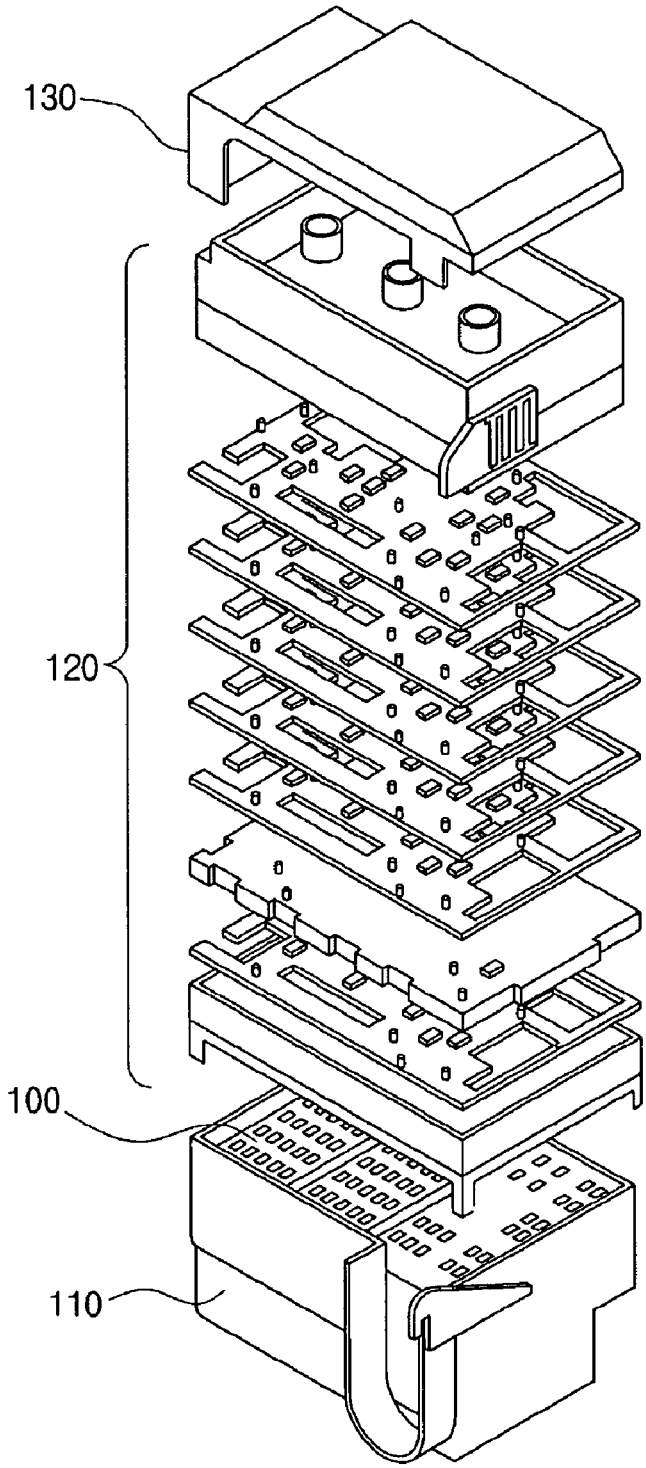
FIGS. 1 and 2 are perspective views illustrating the structure of a conventional junction box.
Figure 2:
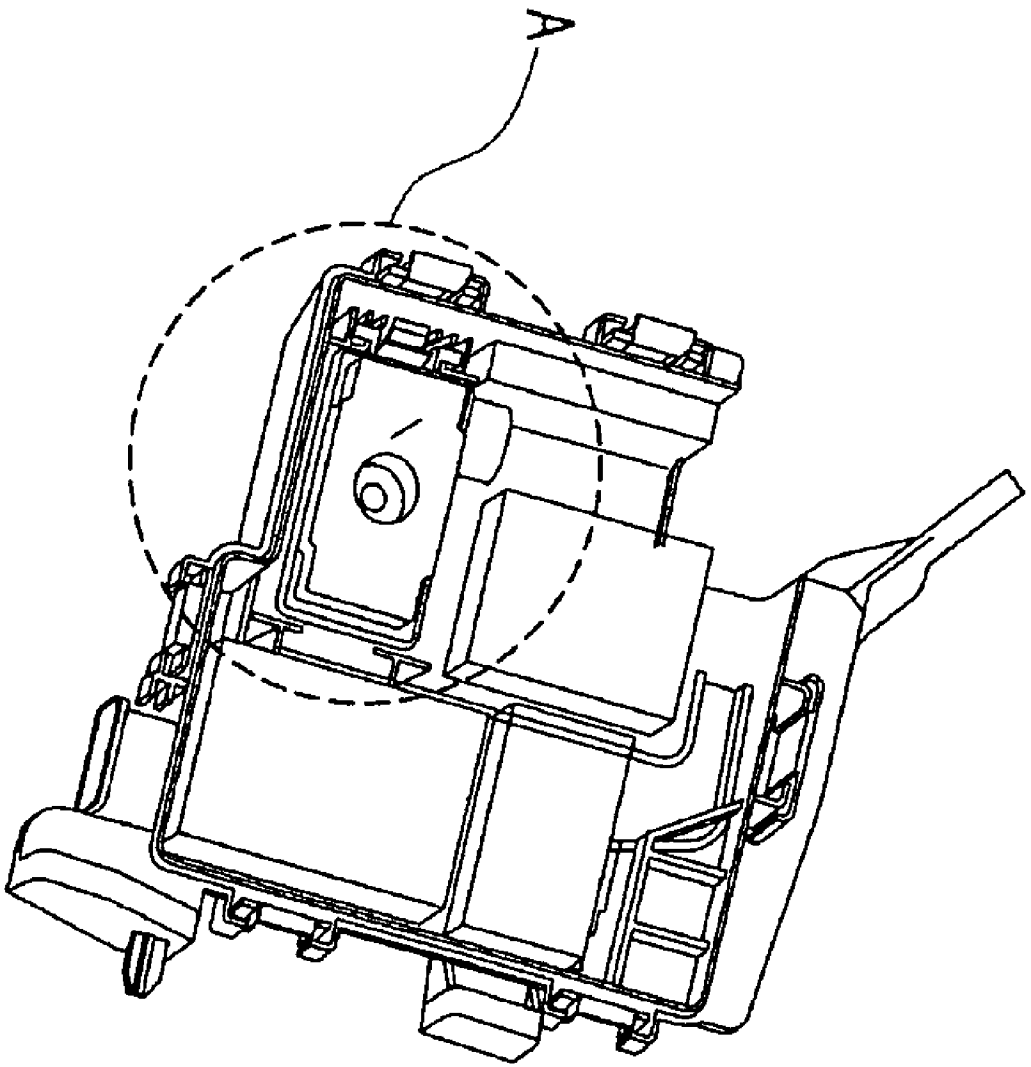
Figure 3:
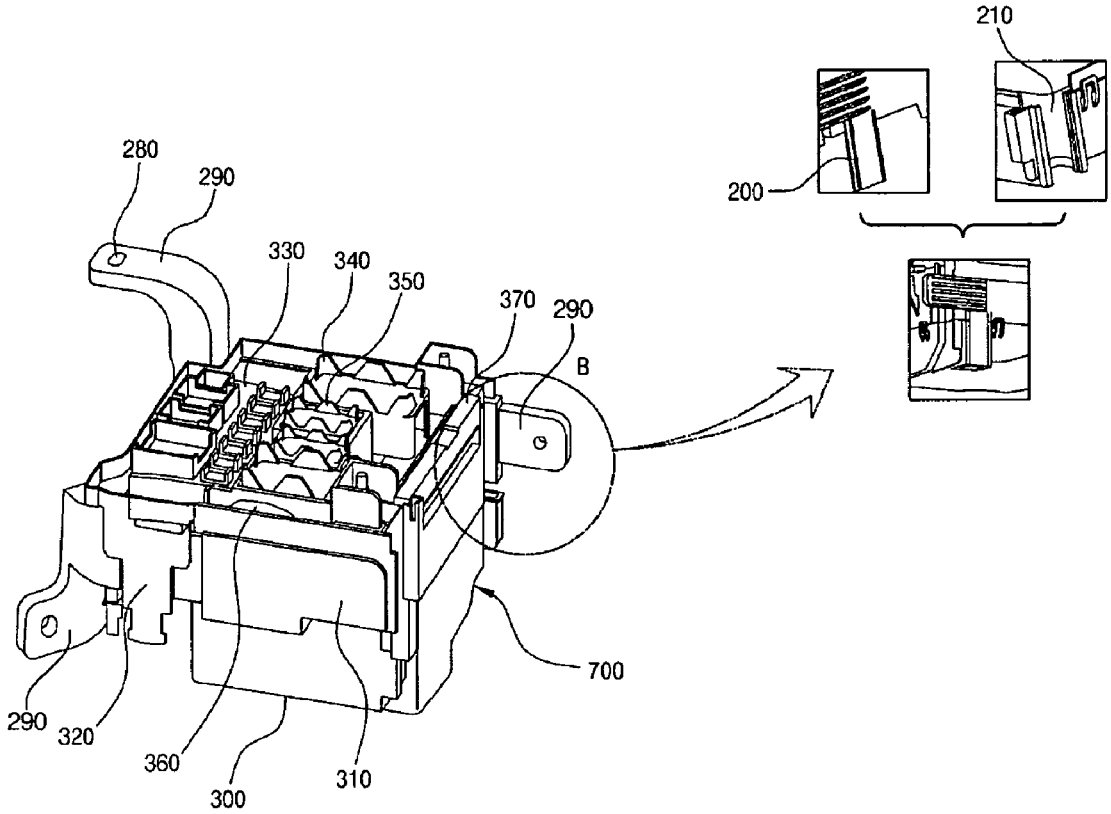
FIG. 3 is a perspective view illustrating a junction box of a block type structure according to an exemplary embodiment of the present invention.
Figure 4:
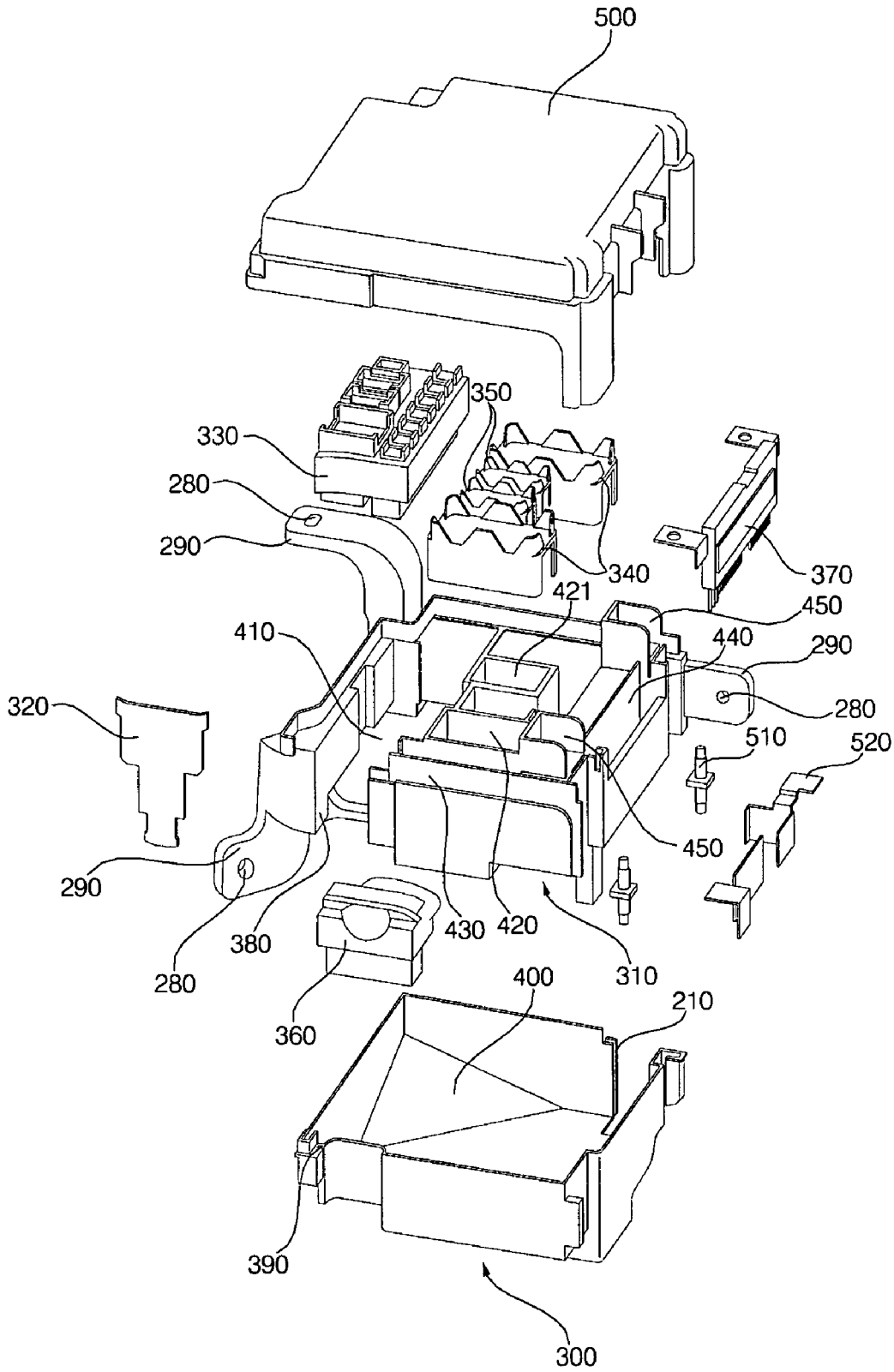
FIG. 4 is an exploded perspective view of a junction box of a block type structure according to an exemplary embodiment of the present invention.
Figure 5:
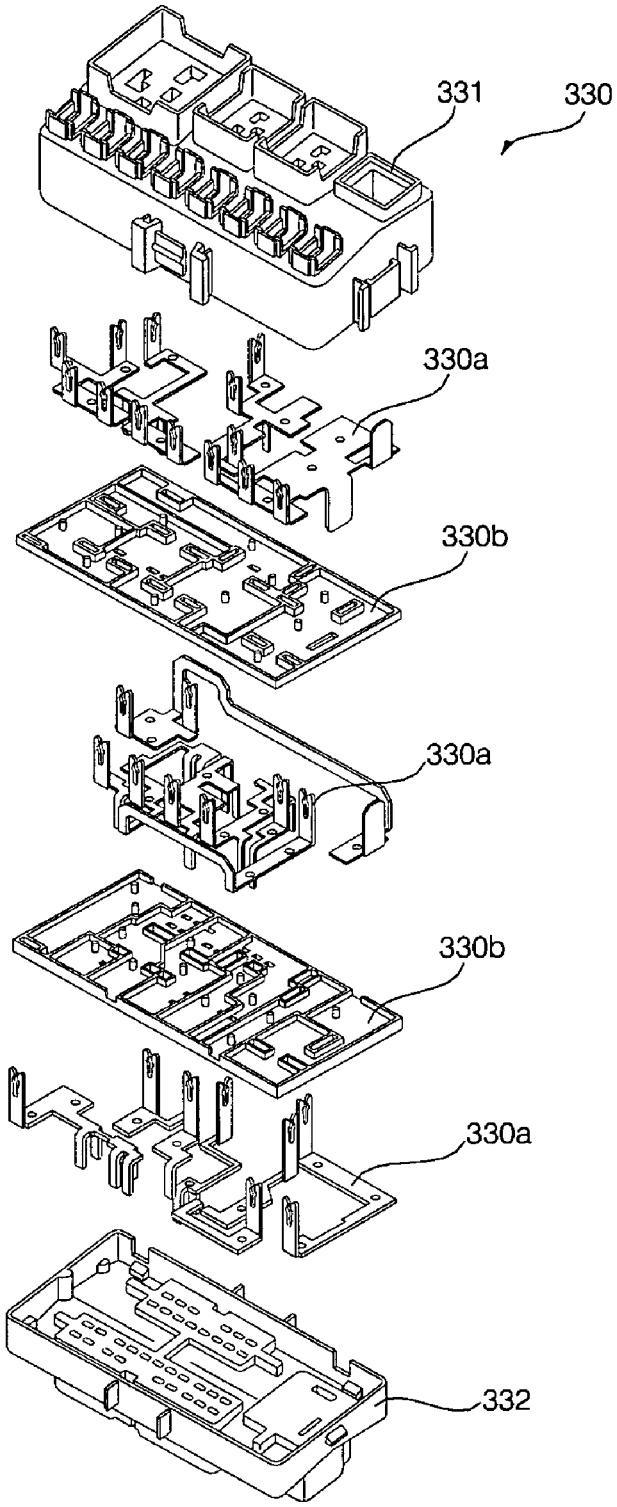
FIG. 5 is an exploded perspective view illustrating the busbar block of FIG. 3.

FIG. 3 is a perspective view illustrating a junction box having a block structure according to an exemplary embodiment of the present invention. FIG. 4 is an exploded perspective view of a junction box having a block type structure according to an exemplary embodiment of the present invention. FIG. 5 is an exploded perspective view illustrating the busbar block of FIG. 3.

As shown in FIG. 3, the junction box having a block type structure includes a lower cover 300 and a main body 310 coupled thereto. Such a junction box performs as an intermediary of an electronic control unit for distributing power supplied from a power supply unit (not shown) and for controlling various electrical parts provided in vehicles.

The structures and shapes of components of the junction box are described in detail.

As shown in FIG. 4, an inner groove 400 of a quadrangular shape having an opened upper part in order to receive and couple the main body 310 is formed in the lower cover 300. The lower cover 300 is coupled to a lower part of the main body 310 so as to prevent moisture from penetrating from the outside into the main body 310, thereby improving water tightness of the junction box.

As shown in "B" of FIG. 3, a flat plate 200 having a step surface downwardly extended by a predetermined length is formed in a lower end part of one side of a corner of the main body 310, and a sliding groove 210 having a size corresponding to a width of the flat plate 200 in order to insert and couple the flat plate 200 is formed in the lower cover 300.

The lower cover 300 and the main body 310 are coupled by downwardly sliding the flat plate 200 so that the flat plate 200 is inserted and coupled to the sliding groove 210. The lower cover 300 and the main body 310 thereby improve workability while sustaining water tightness.

Furthermore, in order to secure a coupling force with the main body 310, a clip groove 390 is formed in a portion of the lower cover 300 opposite in a diagonal direction to the sliding groove 210, and a side groove 380 is formed in a position of the main body 310 corresponding to the clip groove 390.

By interposing and coupling a clip 320 to the side groove 380 and the clip groove 390, the lower cover 300 is firmly coupled to the main body 310. In this case, the clip 320 is formed in a shape in which a width of an upper part is narrower than that of a lower part. Although not shown, a guide slot is formed in a thickness portion of the side groove 380 and the clip groove 390 such that left and right ends of the clip 320 can be inserted and coupled to the guide slot by downwardly sliding the ends of the clip 320.

A plurality of block grooves (410, 420, 421, 430, and 440) being able to receive various kinds of block assemblies are formed in an upper part of the main body 310. The various kinds of block assemblies include relay blocks (340, 350) for turning on/off a signal, a connector block 360 for connecting components to each other, a multi-fuse block 370 for intercepting an over current, and a busbar block 330 including a busbar made of a metal plate, instead of a conventional power cable in order to distribute power supplied from a power supply unit (not shown).

The shapes and positions of the plurality of block grooves (410, 420, 421, 430, and 440) formed in the upper part of the main body 310 are described in detail hereinafter.

In a portion adjacent to one side of an upper part of the main body 310, the busbar block groove 410 of a quadrangular structure is formed to be penetrated in a length direction in which the side groove 380 of the main body 310 for receiving the busbar block 330 is formed.

As shown in FIG. 5, the busbar block 330 is formed by alternately stacking a plurality of busbars 330*a* and insulation plates 330*b* between an upper case 331 and a lower case 332.

It is preferable that the busbar block 330 has a lower part of a quadrangular structure in order to be inserted to and received in the busbar block groove 410. It is also preferable that the insulation plate 330*b* and the busbar 330*a* are standardized ones that can be applied to various vehicle models.

Four relay block grooves (420, 421) for receiving the relay blocks (340, 350) are formed in one side of the busbar block groove 410, i.e. a middle portion of the main body 310. A connector block groove 430 for receiving the connector block 360 is formed in one side of the relay block grooves (420, 421).

The relay blocks (340, 350) may include two of mini relay blocks 340 and two of micro relay blocks 350. It is preferable that the mini relay blocks are standardized ones that can be applied to various vehicle models. It is also preferable that each of the relay blocks (340, 350) has a lower part of a quadrangular structure so that the relay blocks (340, 350) are inserted into and received in the relay block grooves (420, 421).

Further, the micro relay block 350 is operated by an electrical intensity change of other electric circuits according to an opening and closing manipulation of an electric circuit, and it is preferable that two separate contact points of a switch are opened and closed by a rotating connector (not shown) is attracted when a fixed iron core of the coil becomes an electromagnet using a known property that a fixed iron core becomes an electromagnet when a current flows to a coil.

It is preferable that the mini relay block 340 is received at both sides of the micro relay block 350 and is manufactured in a standardized size being able to be applied to various vehicle models.

Unlike the prior art, as a wire (not shown) between relays and a joint for connecting the wire are absorbed within the relay blocks (340, 350), a relay circuit is simplified. The simplified relay circuit reduces manufacturing costs by reducing a mold core upon developing a new junction box and provides increased applicability to various vehicle models.

It is preferable that the connector block 360 has a low part of a quadrangular structure, as in the blocks (330, 340, and 350), so that the connector block 360 may be inserted into and received in the connector block groove 430 formed in the main body 310, and the connector block 360 is processed by 30 pins of an in-line circuit and has a fastening device in order to have a good coupling state.

Further, a multi-fuse block groove 440 for receiving the multi-fuse block 370 is formed in a portion adjacent to the other side of the main body 310, and an insertion groove 450 for receiving both ends of the multi-fuse block 370 is formed at both sides of the multi-fuse block groove 440.

In this state, both the multi-fuse block 370 and a terminal 520 are interposed to and received in the multi-fuse block groove 440, and both ends of the multi-fuse block 370 are received in and fixed to the insertion groove 450 by a pin 510.

In this way, the block assemblies (330, 340, 350, 360, and 370) are inserted into and received in the plurality of block grooves (410, 420, 421, 430, and 440) formed in the upper part of the main body 310.

As shown in FIG. 4, an upper cover 500 is coupled to the upper part of the main body 310 so as to protect the block assemblies (330, 340, 350, 360, and 370).

As components of the junction box having a block type structure according to the present invention are formed in a block shape, the components can be applied to various vehicle models. As shown in Table 1, while the present junction box structure has approximately same number of housed circuits as the prior art structures, it shows reduced weight and costs.

TABLE 1

| | Junction box to which wire-to-wire is not applied (prior art) | Junction box to which wire-to-wire is applied (prior art) | Junction box having a block type structure (present invention) |
|---|---|---|---|
| Quantity of circuit | 239 | 238 | 240 |
| Weight (g) | 1940 | 1860 | 1500 |
| Cost (Korean won) | 46,700 | 35,300 | 26,000 |

A process of assembling a junction box having a block type structure according to an exemplary embodiment of the present invention is described with reference to the accompanying drawings.

FIGS. 6A to 6E illustrate a process of assembling a junction box having a block type structure according to an exemplary embodiment of the present invention.

Figure 6A:
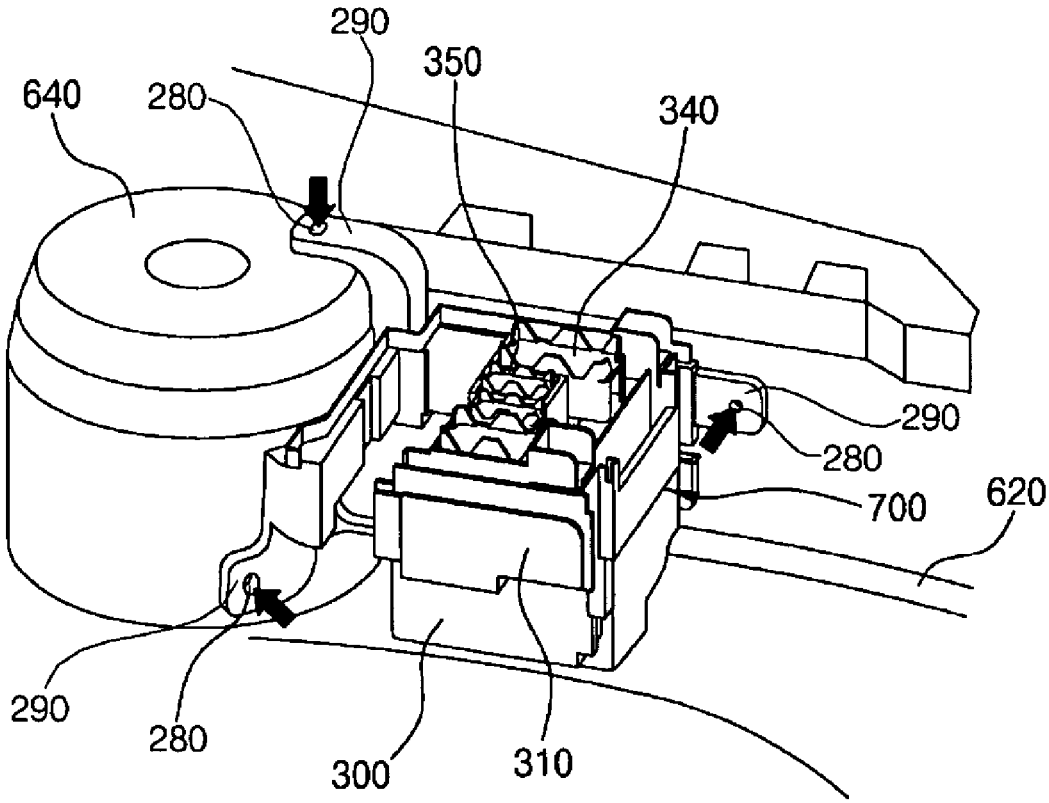
FIGS. 6A to 6E illustrate a process of assembling a junction box of a block type structure according to an exemplary embodiment of the present invention.

First, as shown in FIG. 6A, a front wire-harness 620 is connected to a lower part of a conventional box 700 formed by coupling the lower cover 300 and the main body 310 into which a plurality of relay blocks are inserted, and the conventional box 700 is fixed by volts to three points of one side of an engine room 640, as indicated by an arrow.

In order to fix the main body 310 to the engine room 640 at three points by volts, three protruded plates 290 protruded to match an external shape of the engine room 640 from randomly selected three points of the main body 310 are formed in the main body 310, and the volt hole 280 for inserting and coupling the volt is formed in each protruded plate 290.

Figure 6B:
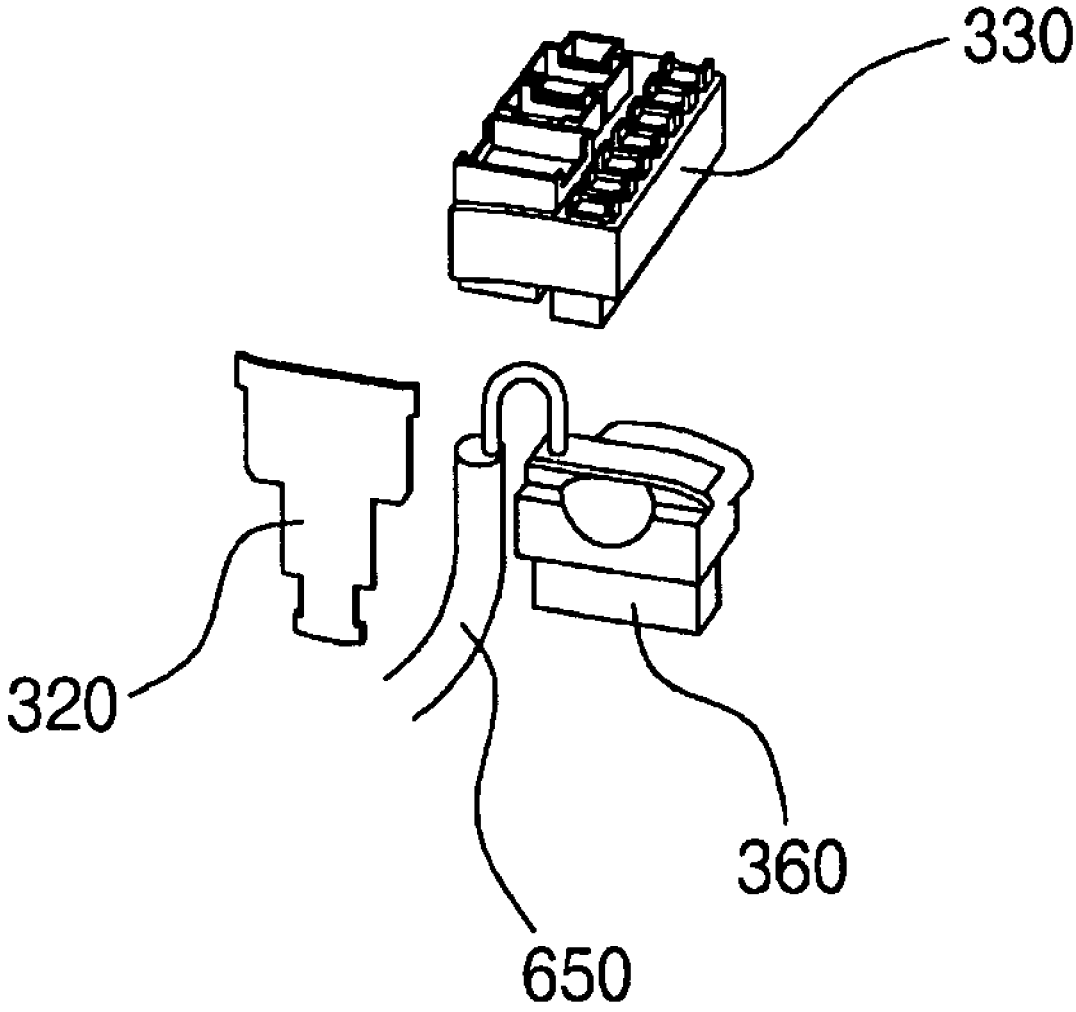

Next, as shown in FIG. 6B, before receiving the busbar block 330 in the busbar block groove 410, the connector block 360 is connected to the control wire-harness 650.

Figure 6C:
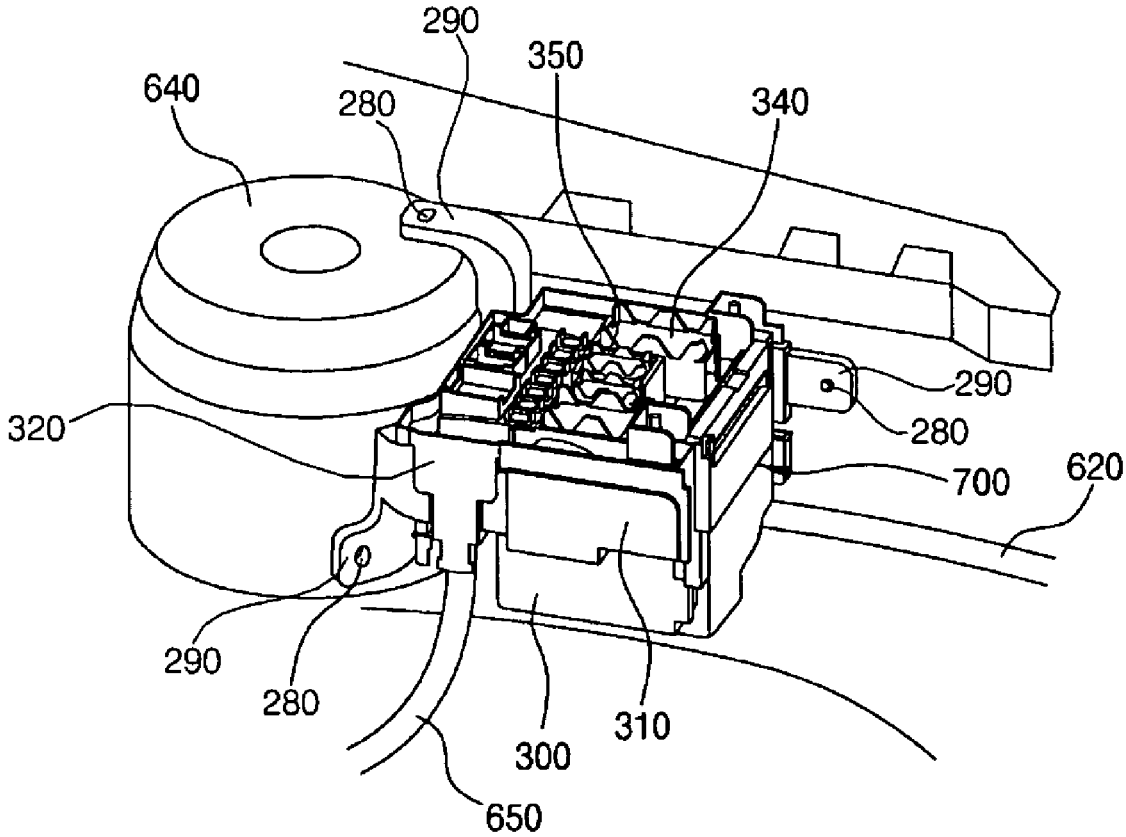

Next, as shown in FIG. 6C, after the busbar block 330 is received in the busbar block groove 410, the wire-harness 650 connected to the connector block 360 is mounted in one side space of the conventional box 700 formed by coupling the main body 310 and the lower cover 300 by receiving the connector block 360 in the connector block groove 430.

Figure 6D:
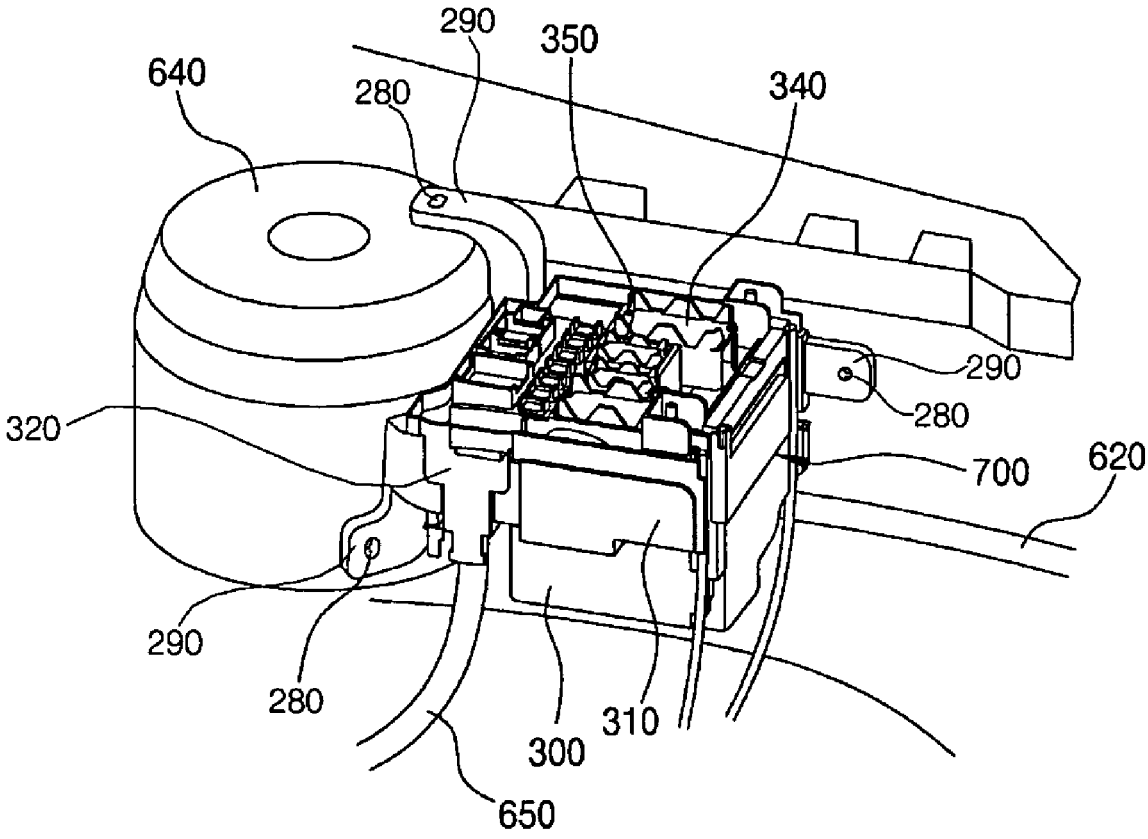
Figure 6E:
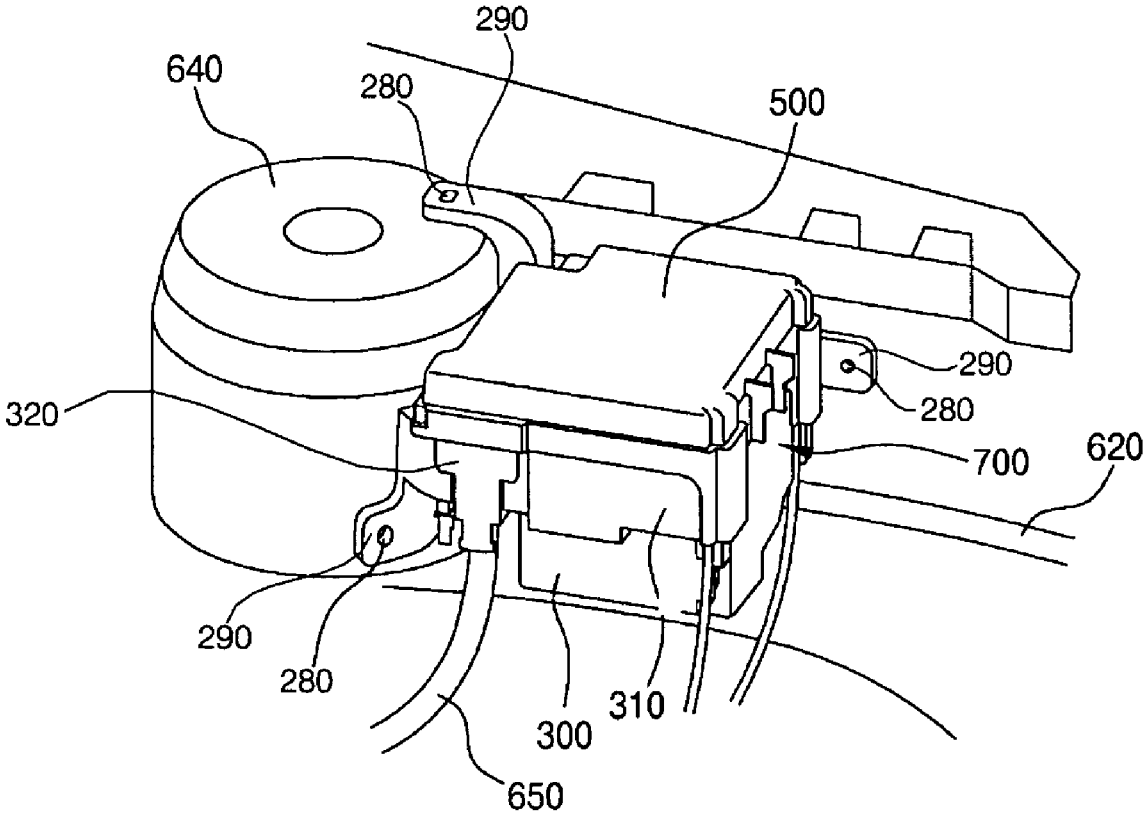

Finally, as shown in FIGS. 6D and 6E, by assembling various terminals (not shown) and coupling the upper cover 500 to the conventional box 700 in which the block assembles (330, 340, 350, 360, and 370) are mounted, assembly of the junction box having a block type structure according to the present invention is completed.

As described above, the junction box having a block type structure according to the present invention provides the following effect.

First, because components mounted in a junction box are formed in a block, it is unnecessary to use a separate retainer and thus a production cost reduces.

Second, by standardizing a busbar block, a relay block, etc. the junction box according to the present invention can be commonly used in other vehicle models.

Third, because a coupling between a main body and components is simpler than that of a conventional junction box, a weight of the junction box reduces.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A junction box having a block type structure comprising:

a lower cover of a quadrangular shape in which an inner groove having an opened upper part is formed and at one side of which a sliding groove is formed;

a main body at one side of which a flat plate having a step surface is coupled to the sliding groove of the lower cover by downwardly sliding and in an upper part of which a plurality of block grooves are formed;

a block assembly being received and assembled in the block grooves of the main body; and an upper cover coupled to the main body by wrapping an upper part of the main body so as to protect the block assembly, wherein the block assembly includes a busbar block comprising a basbar makde of a metal late for distributing power supplied from a power supply unit, wherein the busbar block comprises:

an upper case;

a lower case;

a plurality of busbars disposed between the upper and the lower case; and a plurality of insulation plates disposed between the plurality of busbars.

2. The junction box having a block type structure of claim 1, wherein the block assembly further comprises:

a plurality of relay blocks absorbing a joint and an electric wire between relays for turning on/off a signal;

a multi-fuse block in which a plurality of fuses are provided for intercepting an over current; and a connector block for connecting the busbar block, the relay block, and the multi-fuse block to each other and connecting a plurality of wire harnesses.

3. The junction box having a block type structure of claim 2, wherein the plurality of block grooves formed in the main body comprise:

a busbar block groove formed adjacently to one side of the main body for receiving the busbar block;

a plurality of relay block grooves formed at one side of the busbar block groove for receiving the plurality of relay blocks;

a connector block groove formed at one side of the relay block groove for receiving the connector block; and a multi-fuse block groove formed adjacently to the other side of the main body for receiving the multi-fuse block.

4. The junction box having a block type structure of claim 2, wherein the plurality of relay blocks comprise two micro relay blocks and two mini relay blocks.

5. The junction box having a block type structure of claim 1, wherein a plurality of protruded plates having a bolt groove for mounting the main body in an engine room are formed in the main body.

6. The junction box having a block type structure of claim 1, wherein one side of the lower cover and one side of the main body are coupled by a clip.

7. The junction box having a block type structure of claim 6, wherein a side groove is formed in the main body for receiving and coupling both ends of the clip by downwardly sliding the clip, and a clip groove is formed in a portion of the lower cover corresponding the position of the side groove for receiving and coupling both ends of the clip.

8. The junction box having a block type structure of claim 6, wherein the clip is formed in a shape in which the width of a lower part is narrower than that of an upper part, and the side groove and the dip groove to which the clip is coupled are formed in a shape corresponding to the shape of the clip.

9. A junction box having a block type structure comprising:

a lower cover of a quadrangular shape in which an inner groove having an opened upper part is formed and at one side of which a sliding groove is formed;

a main body at one side of which a flat plate having a step surface is coupled to the sliding groove of the lower cover by downwardly sliding and in an upper part of which a plurality of block grooves are formed;

a block assembly being received and assembled in the block grooves of the main body; and an upper cover coupled to the main body by wrapping an upper part of the main body so as to protect the block assembly, wherein the block assembly further comprises:

a plurality of relay blocks absorbing a joint and an electric wire between relays for turning on/off a signal;

a multi-fuse block in which a plurality of fuses are provided for intercepting an over current; and a connector block for connecting the busbar block, the relay block, and the multi-fuse block to each other and connecting a plurality of wire harnesses, wherein each of the blocks of the block assembly is formed in a relay block standardized so as to be applied to various vehicle models.

* * * * *